US008016036B2

(12) United States Patent
Kirkwood et al.

(10) Patent No.: US 8,016,036 B2
(45) Date of Patent: Sep. 13, 2011

(54) TAGGING A FORMATION FOR USE IN WELLBORE RELATED OPERATIONS

(75) Inventors: Andrew D. Kirkwood, Houston, TX (US); Stephen P. Monroe, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 109 days.

(21) Appl. No.: 12/267,771

(22) Filed: Nov. 10, 2008

(65) Prior Publication Data

US 2009/0120637 A1 May 14, 2009

Related U.S. Application Data

(60) Provisional application No. 60/987,897, filed on Nov. 14, 2007.

(51) Int. Cl.
*E21B 47/09* (2006.01)

(52) U.S. Cl. ..... 166/255.1; 166/254.1; 166/66

(58) Field of Classification Search ..... 166/255.1, 166/250.12, 254.1, 250.01, 66
See application file for complete search history.

(56) References Cited

U.S. PATENT DOCUMENTS

| | | | | |
|---|---|---|---|---|
| 2,337,269 | A | 12/1943 | Piety | |
| 2,476,136 | A * | 7/1949 | Doll | 166/254.2 |
| 2,476,137 | A * | 7/1949 | Doll | 166/254.1 |
| 2,550,004 | A * | 4/1951 | Doll | 33/1 H |
| 2,770,736 | A | 11/1956 | Krasnow | |
| 3,566,979 | A | 3/1971 | Bennett et al. | |
| 4,572,293 | A | 2/1986 | Wilson et al. | |
| 5,279,366 | A | 1/1994 | Scholes | |
| 5,753,813 | A | 5/1998 | Hagiwara | |
| 6,125,934 | A * | 10/2000 | Lenn et al. | 166/250.12 |
| 6,333,699 | B1 | 12/2001 | Zierolf | |
| 6,516,663 | B2 | 2/2003 | Wong | |
| 7,204,308 | B2 | 4/2007 | Dudley et al. | |
| 7,703,515 | B2 * | 4/2010 | Chouzenoux et al. | 166/254.1 |
| 2005/0097911 | A1 * | 5/2005 | Revellat et al. | 62/259.2 |
| 2005/0194132 | A1 | 9/2005 | Dudley et al. | |
| 2006/0005965 | A1 * | 1/2006 | Chouzenoux et al. | 166/250.11 |
| 2007/0056771 | A1 | 3/2007 | Gopalan et al. | |
| 2007/0119597 | A1 * | 5/2007 | McHardy et al. | 166/380 |

FOREIGN PATENT DOCUMENTS

| | | | |
|---|---|---|---|
| EP | 0984135 | A2 | 3/2000 |
| EP | 1045113 | A | 10/2000 |
| EP | 1662673 | A1 | 5/2006 |
| GB | 2360533 | A | 9/2001 |
| GB | 2404208 | A | 1/2005 |

* cited by examiner

*Primary Examiner* — Kenneth Thompson
*Assistant Examiner* — Catherine Loikith
(74) *Attorney, Agent, or Firm* — Cantor Colburn LLP

(57) ABSTRACT

A system for positioning a wellbore tool in a wellbore intersecting a subterranean formation includes a tag embedded in the formation using a tag insertion device. The tag may be configured to transmit a signal that includes information. A wellbore tool may utilize a tag detection device to operatively link with the tag. This operative link may provide an indication of the relative position of the tag detection device or some other information.

20 Claims, 5 Drawing Sheets

TAGGING A FORMATION FOR USE IN WELLBORE RELATED OPERATIONS

CROSS-REFERENCE TO RELATED APPLICATION

This application claims the benefit of U.S. Provisional Patent Application No. 60/987,897 filed Nov. 14, 2007.

BACKGROUND OF THE DISCLOSURE

1. Field of the Disclosure

This disclosure relates generally to devices, systems and methods for positioning and using equipment used in connection with the drilling, completion and/or workover of oilfield wells.

2. Description of the Related Art

Valuable hydrocarbon deposits, such as those containing oil and gas, are often found in subterranean formations located thousands of feet below the surface of the Earth. To recover these hydrocarbon deposits, boreholes or wellbores are drilled by rotating a drill bit attached to a drilling assembly, also referred to herein as a "bottom hole assembly" or "BHA." Such a drilling assembly is attached to the downhole end of a tubing or drill string made up of jointed rigid pipe or a flexible tubing coiled on a reel ("coiled tubing"). For directional drilling, the drilling assembly can use a steering unit to direct the drill bit along a desired wellbore trajectory.

These drilled wellbores, which can include complex three-dimensional trajectories, intersect various formations of interest. During drilling and in later completion activities, success or failure of effectively producing hydrocarbons from a given formation can hinge on precisely measuring the depth of a given formation and precisely positioning a wellbore tool at a depth corresponding to a given formation. In some instances, a hydrocarbon bearing zone can be only a meter or so in depth. Thus, the positioning of wellbore tools such as a perforating gun or a kickoff for a lateral bore must be positioned well within that one meter range.

Conventional depth measurement systems utilize surface-based equipment and techniques for determining a measured depth of a downhole tool, such as a bottomhole assembly. Conveyance devices, such as drill pipe or wirelines, that used to convey downhole tooling are susceptible to stretching during deployment. Because these conveyance devices can span hundreds of meters or more, the elongation of the conveyance device may significantly impact surface depth measurements. That is, for instance, a surface measurement may indicate that a downhole tool is at 800 meters, whereas, due to factors such as tensile loading, the tool is actually at 840 meters. Thus, surface measurements may not provide the accuracy needed to position wellbore equipment within a narrow zone of interest, e.g., within a tolerance of a half-meter. The present disclosure is directed to methods and devices for accurately positioning wellbore tooling as well as methods and devices for enhancing wellbore operations.

SUMMARY OF THE DISCLOSURE

In aspects, the present disclosure provides a method for positioning a wellbore tool in a wellbore intersecting a subterranean formation. In one embodiment, the method may include positioning a tag at a selected location in the formation, and positioning the wellbore tool in the wellbore with reference to the tag. In aspects, another method for positioning a wellbore tool in a wellbore intersecting a subterranean formation include determining a parameter of interest relating to the formation; determining a selected location along the wellbore using the determined parameter of interest; positioning a tag at the selected location in the formation; detecting the tag; and positioning the wellbore tool in the wellbore with reference to the tag. The method may further include logging a section of the formation to measure the parameter of interest relating to the formation, and re-logging the section of the wellbore to locate the selected location. In aspects, still another method for positioning one or more devices in a wellbore intersecting a subterranean formation may include logging a section of the formation while traversing the wellbore in a first direction to obtain a first set of data relating to the formation; determining a selected location along the wellbore by processing the first set of data; logging the section of the formation while traversing the wellbore in a second direction opposite to the first direction to obtain a second set of data relating to the formation; processing the second set of data to find the selected location; and positioning a tag at the selected location in the formation.

In aspects, the present disclosure provides a system for positioning a wellbore tool in a wellbore intersecting a subterranean formation. The system may include a tag positioned in the formation; a tag detection device operatively linking to the tag; and a conveyance device conveying the tag detection device into the wellbore. An illustrative system may include a logging tool configured to determine at least one parameter of interest relating to the formation; a tag configured to be positioned in the formation; a tag insertion tool configured to insert the tag into the formation; and a conveyance device conveying the tag insertion tool and the logging tool into the wellbore. In aspects, another illustrative system may include a tag configured to be embedded in the subterranean formation to operate as the reference object; and an injector configured to embed the tag into the subterranean formation.

It should be understood that examples of the more important features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1A:
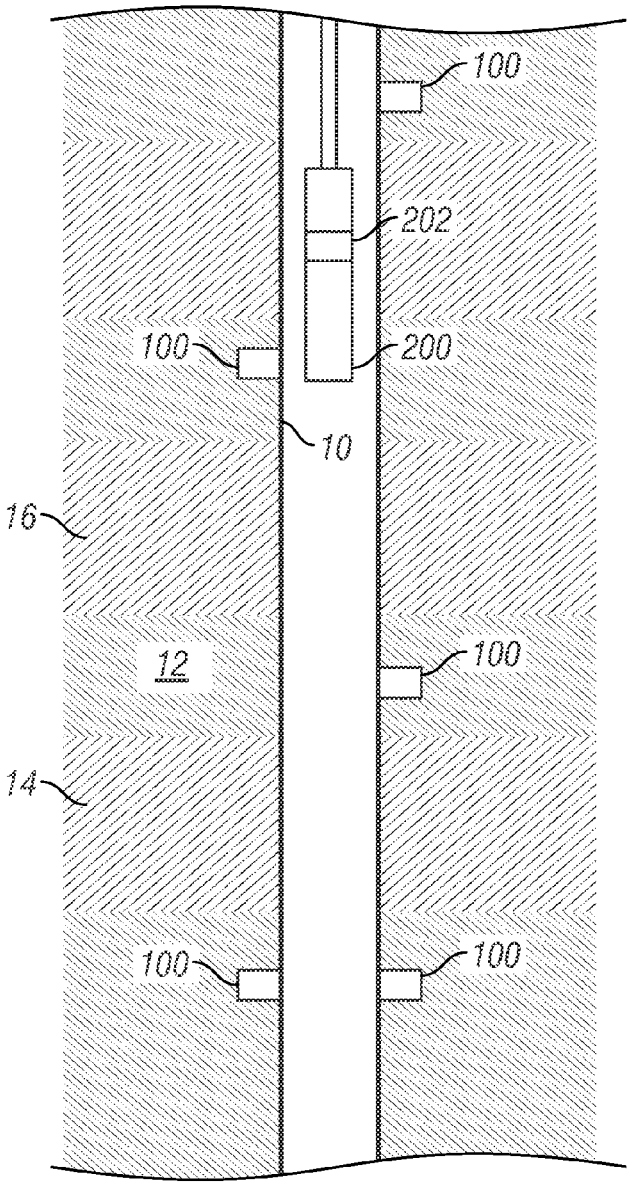
FIG. 1A schematically illustrates a reference tag according to one embodiment of the present disclosure that is embedded in a subterranean formation.

The present disclosure, in one aspect relates to devices and methods for positioning wellbore tools and/or obtaining subsurface measured data. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described has having one or more features or a combination of two or more features, such a feature or a combination of features should not be construed as essential unless expressly stated as essential.

Referring initially to FIG. 1A, there is shown a wellbore 10 intersecting a formation 12. In embodiments, one or more tags 100 are positioned along the wellbore 10 at selected locations in the rock and earth of the formation 12. The tags 100 operate as a reference object or device that may assist in determining the orientation and/or position of one or more tools subsequently deployed in the wellbore 10. An illustrative tool, which has been labeled with numeral 200, may be any tool used during any stage of the life of a well, including drilling, completion, work-over and production. In embodiments, the tool 200 may include a tag detection device 202 that operatively links to the tags 100. This operative link may be as simple as a detection of the tag 100 or as complex as a bi-direction data communication with and power transfer to the tag 100. Establishing this operative link provides an indication that the tool 200 has reached a previously identified location in the wellbore, provides information that may be useful in operating the tool 200, and/or facilitates a desired wellbore operation. The data and information may be transmitted to the surface and/or used downhole.

Figure 1B:
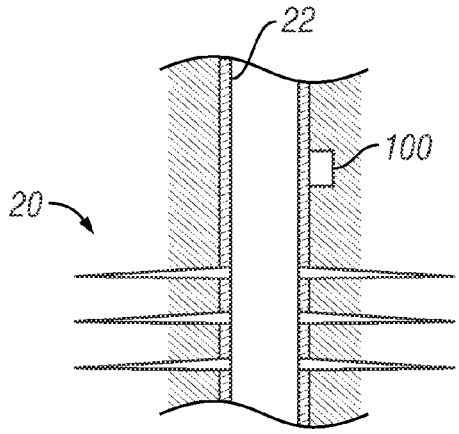
FIG. 1B schematically illustrates a reference tag according to one embodiment of the present disclosure that is embedded in a subterranean formation and positioned radially external of a wellbore tubular.

The tag 100 may be used to orient and/or position the wellbore tool 200 with reference to a location parameter such as measured depth, true vertical depth, borehole highside, azimuth, etc. The orientation and/or position may also be with reference to a subsurface feature such as a production zone 14, a water zone 16, a particular point or region of interest in the formation 12, as well as features such a bed boundaries, fluid contacts between fluids such as water and oil, unstable zones, etc. Referring now to FIG. 1B, the tag 100 may also be used in connection with constructed features such as a perforated zone 20 or other features as kick-off points (not shown) for branch wells, locations of liner hangers (not shown), packers (not shown) etc. The tag 100 may be used in an open hole as shown in FIG. 1A or radially external to wellbore equipment such as tubular 22, which may be a liner or casing.

In one mode of operation, the tool 200 uses the tag detection device 202 to detect, communicate, or in some manner operatively link with the tag 100. Upon establishing this operative link with the tag 100, surface personnel can then determine the position of the tool 200 relative to the feature of interest. The tool 200 may be operated to locate the tag 100, which then enables positioning of the tool 200 relative to the tag 100.

Figure 2:
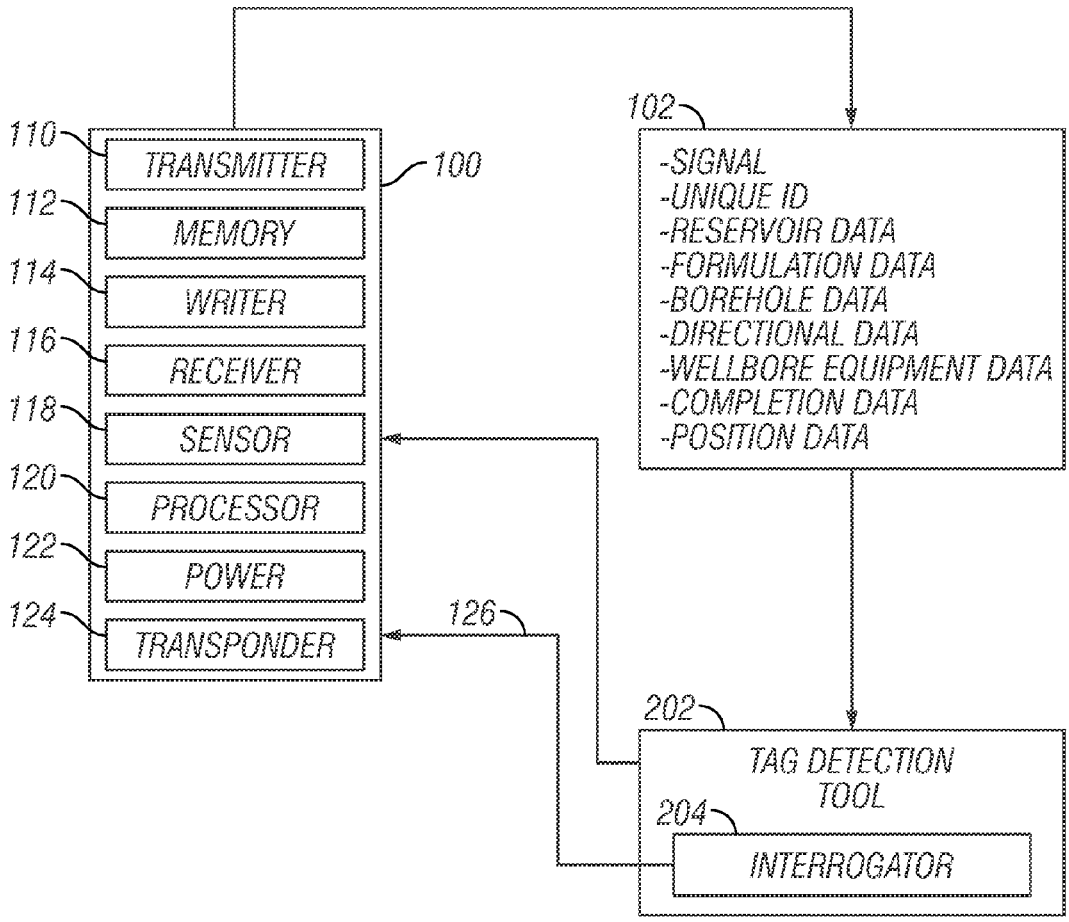
FIG. 2 functionally illustrates a tag according to one embodiment of the present disclosure.

While the tag 100 may operate in some embodiments as a substantially stationary reference object that may be used to position wellbore tools, the tag 100 may also be configured to receive, collect, store and transmit information. The configuration of the tag 100, therefore, may be adjusted as needed to meet a particular function. Referring now to FIG. 2, there is shown in functional format one embodiment of a tag 100. It is emphasized that the features shown in FIG. 2 may be optional and as such are not essential.

In one arrangement, the tag 100 emits an identifiable signal 102. The characteristics of the signal 102, such as amplitude or frequency, may be sufficient for the tool 200 to identify or locate the tag 100. The signal 102, in certain embodiments, may also contain information that includes, but is not limited to, a unique identification value for that tag 100. In certain embodiments, the signal 102 may include data such as reservoir data such as pressure, temperature, flow rates; formation data such as resistivity, density, porosity; fluid data such as fluid composition, borehole data such as highside, borehole diameter; directional data such as inclination, azimuth, etc. The data may be measurements made by in situ sensors or by tools that have previously run in the wellbore 10. In certain embodiments, the signal 102 may include position data such as a distance to one or more features of interest described previously. The signals may be digital, analog, encoded pulses or any other information-bearing transmission.

The constituent components of the tag 100 may depend on the particular application involved, the nature the signal 102 and/or the degree of information that is to be conveyed by the signal 102. For instance, the tag 100 may utilize a transmitter 110 that transmits a signal having a predetermined characteristic such as amplitude or frequency that enables identification of the tag 100. To add information to the signal 102, a memory 112 may be utilized to store data. The data may be written to the memory 112 by an external device (not shown) or by a resident data writer 114. In some embodiments, the tag 100 may operate continuously or periodically. In some embodiments, a receiver 116 may be used to receive command signals or data signals transmitted to the tag 100. For instance, the tag 100 may assume a "sleep" or "dormant" mode until a command signal is received by the receiver 116. Upon receiving the command signal, the transmitter 110 may transmit the signal 102. The receiver 116 may also be used to receive data that is thereafter written to the memory 112 by the writer 114. In embodiments, a sensor 118 may be used to measure one or more desired parameters of interest and a processor 120 may be used to process the measured data or any other received data. The processing may include, but is not limited to, digitizing, decimating, filtering, etc. The transmitter 100 may include an onboard power supply 122, which may be rechargeable. The transmitter 100 may also be energized by using as an induction device on a tool or by a suitable power conductor to a remote power supply in the wellbore or at the surface.

In one arrangement, the tag 100 may use radio frequency identification (RFID) principles to establish an operative link with the tool 200. In such an arrangement, the tag 100 may include a transponder 124 and the tag detection device 202 of the tool 200 may include an interrogator or transceiver 204. The transponder 124 transmits the signal 102 in response to an interrogating signal 126 transmitted by the transceiver 204. The transponder 124 can be passive or active. In one variant of the passive transponder 124, an incoming radio frequency signal or interrogating signal 126 generates sufficient electrical current induced in an antenna (not shown) provided in the transponder 124 for circuitry such as a CMOS integrated circuit in the transponder 124 to power up and transmit the responsive signal 102. As noted previously, the responsive signal 102 can include a preprogrammed value such as an ID number as well as collected data. In one variant of the active transponder 124, the internal power source 122 supplies power for the onboard circuitry. The active transponder 124 can transmit such signals in response to a signal or transmit the signals without a prompt at a specified time, event or interval.

It is emphasized that RFID devices are merely illustrative of devices that be used to establish communication between the tag 100 and the tag detection device 202. In other embodiments, operative links between the tag 100 and the tag detection device 202 may be based on acoustic signals, magnetic signals, optical signals, pressure pulses or other energy waves that may be emitted or modulated in a controlled manner. For example, the tag 100 may be partially or completed formed of an energy emitting material such as a radioactive material or a magnetic material. The energy emitting materials may be encapsulated in a shell or sheathing that is substantially transparent to the emitted energy. The encapsulation may be useful to protect the energy emitting material for the corrosive wellbore environment and help prevent the energy emitting material from migrating or dispersing. The tag detection device 202 may be equipped with a device to detect the energy emitted by the tag 100, such as a radiation detector or magnetometer.

Figure 3A:
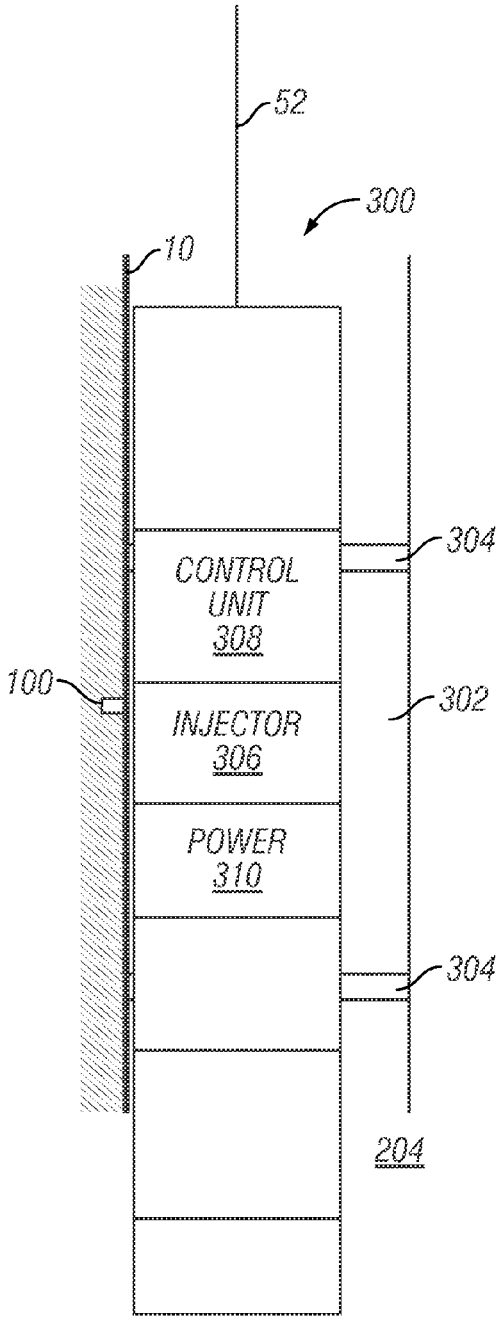
FIGS. 3A and 3B schematically illustrate tag insertion tools made according to one embodiment of the present disclosure.
Figure 3B:
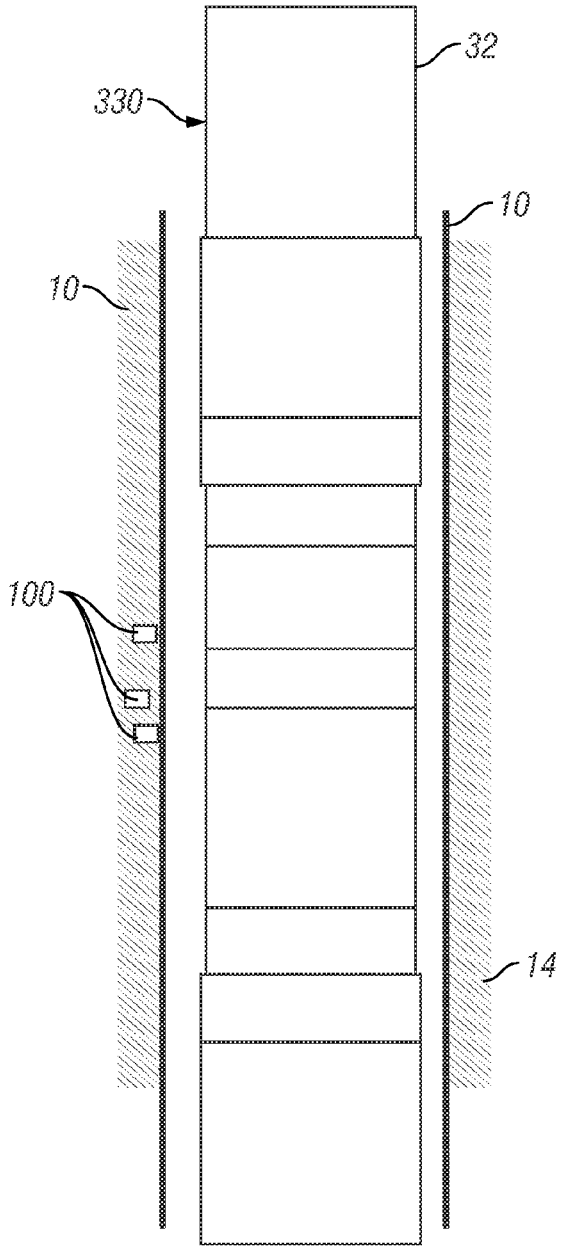

The tag 100 may be embedded into the formation using any number of devices, two of which are shown in FIGS. 3A and 3B. FIG. 3A illustrates an insertion tool 300 that plants the tag 100 in a controlled manner into the formation. The insertion tool 300 includes an injection module 302 and one or more decentralizing arms 304. The injection module 302 may include an injector 306, a control unit or controller 308 and a power supply 310. The injection module 302 may be configured to use electrical power, hydraulic power and/or pneumatic power. In one arrangement, the injector 306 may be a piston or ram device that is actuated by pressurized fluid, such as oil or gas. For example, the tag 100 may be fixed to a member such as a pad or a rod (not shown) that is driven against or into the formation. In other embodiments, the tag 100 may be inserted into the formation by being loaded into a member such as a tube that is operatively coupled to a charge device that provides a propelling force using hydraulics, pneumatics or pyrotechnics. In other embodiments, the injection module 302 may utilize an expandable bladder that is expanded into engagement with a wellbore wall. In still other arrangements, an electric motor can rotate an appropriately threaded shaft to drive a tag 100 into the formation. In still other embodiments, the injector 306 may use a coring bit arrangement to form a cavity in the formation. The tag 100 may then be deposited into that cavity. To radially displace the injection module 302, the injection module 302 includes the upper and lower decentralizing arms 304. Each arm 304 may be operated by an associated hydraulic system (not shown). Further details regarding coring devices and decentralizing arms are disclosed in U.S. Pat. Nos. 5,411,106 and 6,157,893, which are hereby incorporated by reference for all purposes. The injection module 302 may be mounted on a non-rotating sleeve that remains substantially stationary relative to the wellbore wall while a drill string to which the non-rotating sleeve is coupled rotates. Thus, the injection module 302 physically engages or contacts a wall of the wellbore and forcibly embeds one or more tags 100 into the formation.

In the FIG. 3B embodiment, an injection module 330 propels a tag 100 into the formation. The tag 100 may be propelled or ejected out of the injection module 330 using a propelling force such as pressurized gas or fluid. A pyrotechnic charge in a gun-type arrangement may also be used to "shoot" the tag 100 into the formation. Such an arrangement may be useful for tags that use energy emitting materials such as radioactive materials or magnetic materials. Such an arrangement may also be useful in applications where the injection module 330 is traversing the wellbore. Because the injection module 330 does not physically contact the wall of the wellbore, the tag 100 may be ejected into the formation while the injection module 330 is moving.

The tag or tags 100 may be embedded into the formation at any time during the well construction or during the production life of a well. Illustrative methods for deploying the tags are discussed below.

Figure 4:
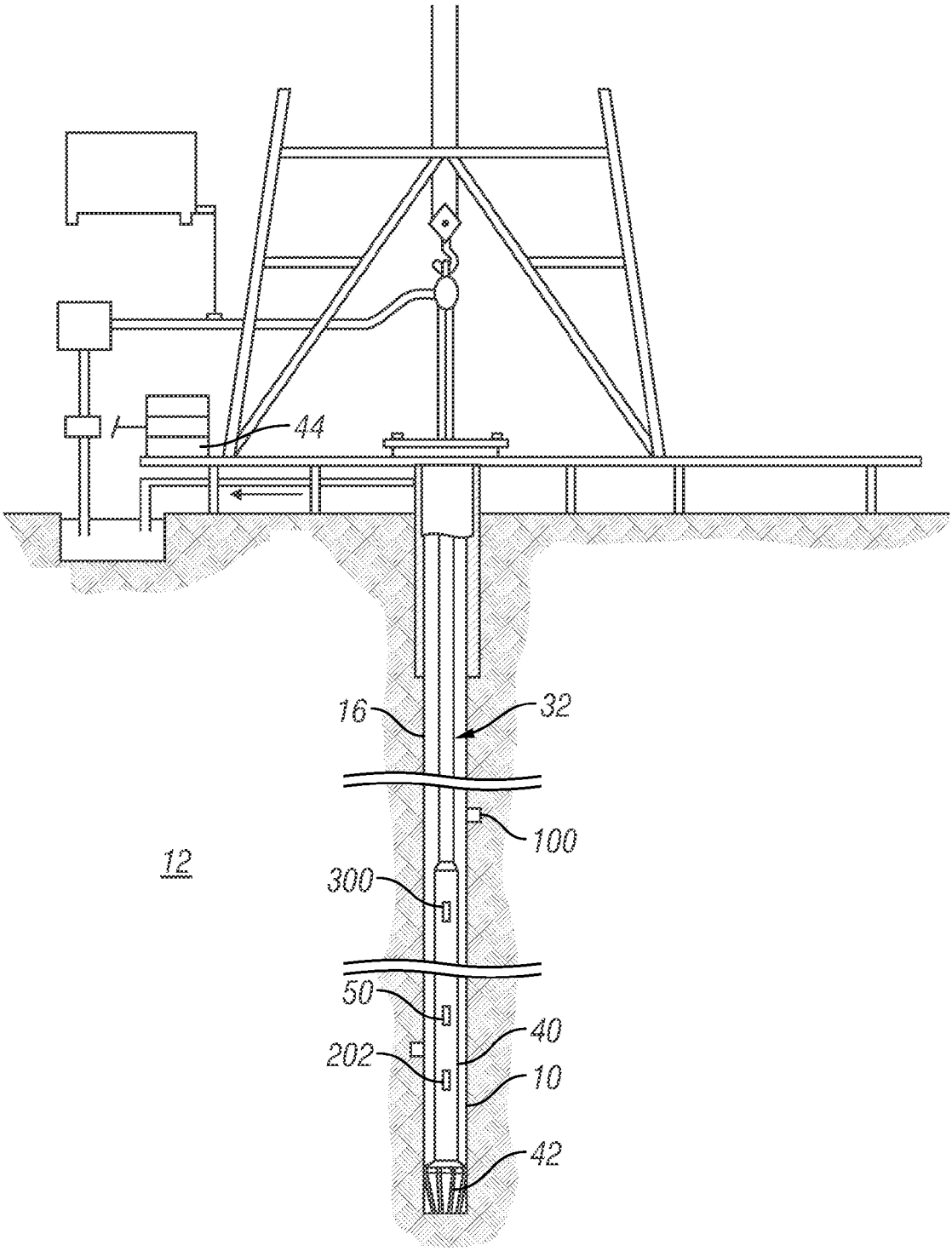
FIG. 4 shows a schematic view of a drilling system according to one embodiment of the present disclosure.

Referring to FIG. 4, there is shown a drill rig 30 positioned over a formation of interest 12. As shown, a wellbore 10 is being drilled into the earth under control of known surface equipment using a drill string 32. The drill string 32 is formed of jointed tubulars and can include a bottomhole assembly (BHA) 40 having a drill bit 42 at a distal end. A tag insertion tool, such as that shown in FIG. 3A or 3B, may be positioned along the BHA 40. Merely for ease of explanation, the tag insertion tool 300 is shown. Also shown is the tag detection device 202. While a drill string of jointed tubulars is shown, the string can also include coiled tubing, casing joints, liner joints or other equipment used in well completion activities. Additionally, while a land rig is shown, it should be understood that the teachings of the present disclosure can be readily applied to offshore drilling such as that performed on facilities such as drill ships or offshore platforms. A depth measurement system 44 may be provided to generally determine the "measured" or "absolute" depth of the BHA 40.

In one embodiment, the BHA 40 includes logging-while-drilling tools or formation evaluation tools 50 adapted to measure one or more parameters of interest relating to the formation or wellbore. The formation evaluation tools 50 may be positioned downhole of the insertion tool 300 as shown or positioned uphole of the insertion tool 300. It should be understood that the term formation evaluation tool encompasses measurement devices, sensors, and other like devices that, actively or passively, collect data about the various characteristics of the formation, directional sensors for providing information about the tool orientation and direction of movement, formation testing sensors for providing information about the characteristics of the reservoir fluid and for evaluating the reservoir conditions. The formation evaluation sensors may include resistivity sensors for determining the formation resistivity, dielectric constant and the presence or absence of hydrocarbons, acoustic sensors for determining the acoustic porosity of the formation and the bed boundary in formation, nuclear sensors for determining the formation density, nuclear porosity and certain rock characteristics, nuclear magnetic resonance sensors for determining the porosity and other petrophysical characteristics of the formation. The direction and position sensors preferably include a combination of one or more accelerometers and one or more gyroscopes or magnetometers. The accelerometers preferably provide measurements along three axes. The formation testing sensors collect formation fluid samples and determine the properties of the formation fluid, which include physical properties and chemical properties. Sampling tools for collecting samples can include device utilizing probes and/or coring devices. Pressure measurements of the formation provide information about the reservoir characteristics.

In one mode of operation, the BHA 40 drills the wellbore while the trailing formation evaluation tools 50 "log" the well by measuring various parameters of interest that have been previously described. Analysis of the logged measurements, which may be performed downhole and/or at the surface, may reveal a feature of interest to be tagged for future reference. The insertion tool 300 may then be operated to insert a tag 100 into the formation. The tag 100 does not necessarily have to be positioned at the feature of interest because the insertion tool 300 has a known fix axial distance from the formation evaluation tools 50. Prior to insertion, the tag 100 may be encoded with data such as the distance to the feature of interest and other data previously described with reference to the signal 102 shown in FIG. 1.

A variety of techniques may be employed for inserting the tag 100. One method includes injecting the tag 100 "on the fly" as the drill string 32 is moving. Another method includes stopping drilling to embed the tag 100. Still another method includes relogging the well as the drill string 32 is being tripped out of the wellbore 10 to locate the previously identified feature(s) of interest and then inserting the tag 100. In a similar manner, the identification of feature(s) of interest may also be performed as the drill string 32 is being tripped back into the wellbore 10. It should be appreciated that each of these methods provides different time intervals between the initial logging of the well and the subsequent insertion of the tag 100. For example, inserting the tag 100 during a tripping out of the well or subsequent tripping into the wellbore allows surface personnel more time to analyze the logging data to identify feature(s) of interest suitable for tagging.

Figure 5:
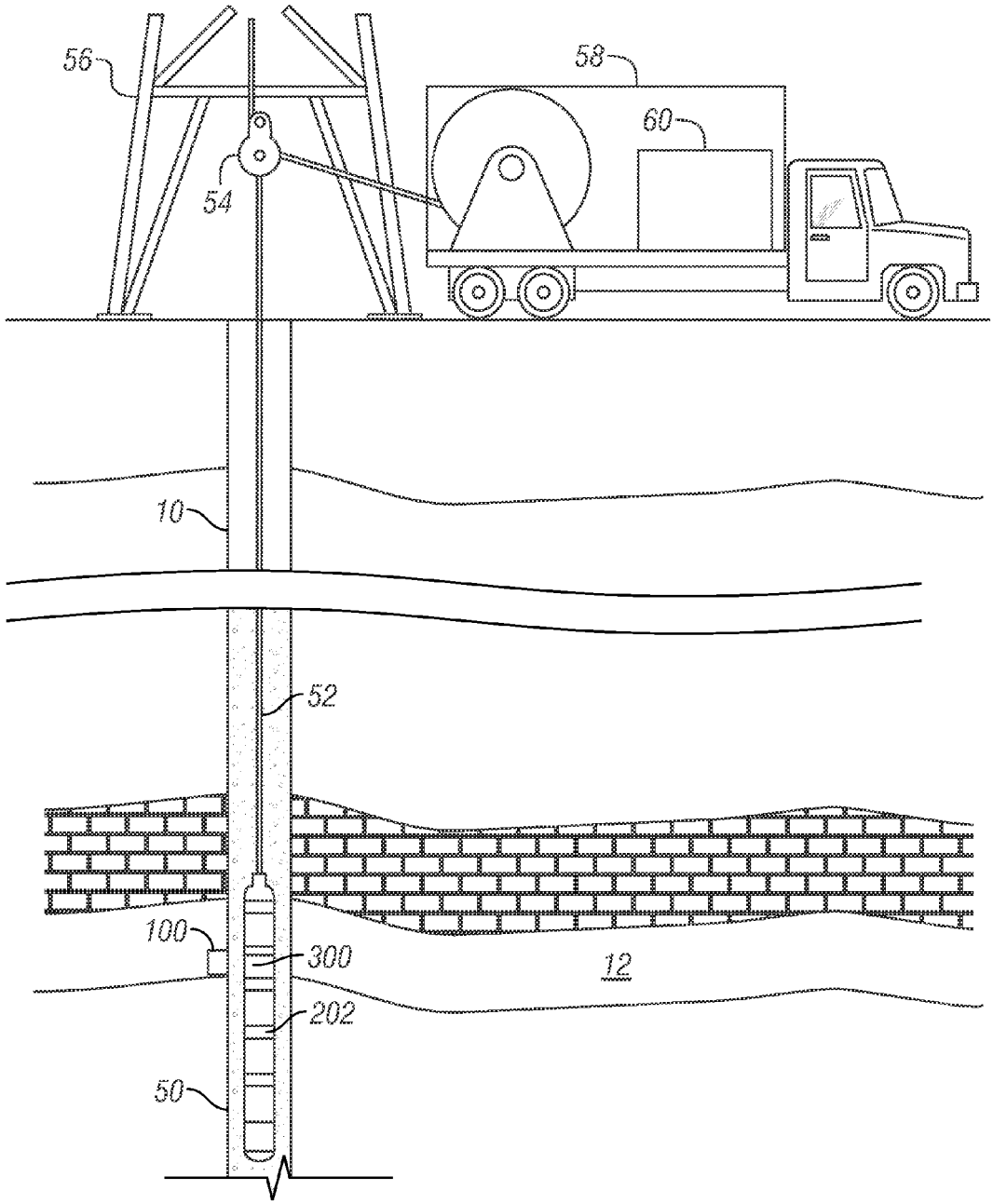
FIG. 5 shows a schematic view of wireline system according to one embodiment of the present disclosure.

The tags 100 may also be deployed outside of the drilling context using tools conveyed into the wellbore 10 by a non-rigid conveyance devices such as a wireline or slick line. Referring now to FIG. 5, there is schematically represented a cross-section of the formation 12 in which is drilled the wellbore 10. Suspended within the wellbore 10 at the bottom end of a non-rigid conveyance member such as a slick line or a wireline 52 are formation evaluation tools 50. Positioned adjacent to the formation evaluation tools 50 is the insertion tool 300. Also shown is the tag detection device 202. The wireline 52 is often carried over a pulley 54 supported by a derrick 56. Wireline deployment and retrieval is performed by a powered which carried by a service truck 58, for example. A control panel 60 interconnected to the tool 100 through the wireline 52 by conventional means controls transmission of electrical power, data/command signals, and also provides control over operation of the components in the formation sampling tool 100.

In one mode of operation, the formation evaluation tools 50 "log" the while being tripped into or out of the wellbore 10. Analysis of the logged measurements, which may be performed downhole and/or at the surface, may reveal a feature of interest to be tagged for future reference. Using methods previously discussed, the insertion tool 300 may be operated to insert a tag 100 into the formation. Prior to insertion, the tag 100 may be encoded with data such as the distance to the feature of interest and other data previously described with reference to the signal 102 shown in FIG. 2.

With respect to FIGS. 1A, 1B, 4 and 5, it should be appreciated that the tagging of features of interest in the wellbore can enhance the effectiveness of subsequent wellbore operations. For instance, the depth, orientation and position of the BHA 40 may be more precisely determined by reference to the tags 100 previously positioned in the wellbore. That is, as the drill string 3 is being tripped into the wellbore 10, the tag detection device 202 may be operated to locate the tag 100 that has been positioned at the desired location. Such a tag 100 may emit a signal 102 (FIG. 2) having a unique identification value. Thus, for example, rather than relying on measured depth at the surface to identify a kick-off point for a branch wellbore, the tags 100 may be utilized to position a whipstock (not shown) or other diverting device at the appropriate location in the wellbore.

In the completions and production context, the tags 100 may be used to identify the location of features of interest to well owners and operator such as potential pay zones, depleted zones, unstable zones, "thief" zones (e.g., zones having relatively low pore pressures), etc. Each of these features may be tagged with a tag 100 transmitting a unique identification signal. Thus, the tags 100 may function as in situ references for such features during the life of the well. Because subsequent operations in the wellbore 10 may utilize these tags 100, surface personnel may more precise position perforating tools, screens, gravel packs, zone isolation equipment such as packers, production tubing, artificial lift pumps, etc.

With conventional systems, surface measured depth for positioning such devices in relatively deep wells, say five thousand meters, may have an error of seventy to one hundred meters. Such an error can lead to less than optimal positioning of completion tools. However, use of the tags 100 may substantially reduce the error substantially because the distances involved with positioning tooling with respect to the tags 100 may be in the order of, say, twenty to forty meters, which, of course, would involve a correspondingly smaller error in measured distance. It should be appreciated that the tags 100 may be used solely or in conjunction with surface depth measurement systems for accurate placement wellbore tools.

During the life of a well, in addition to providing a useful reference point for positioning tools in the well, the tags 100 may be used to characterize the changes in a formation or reservoir over time. For instance, downhole measurements, such as nuclear measurements, resistivity, or acoustics, may be used to locate and gas-oil and or oil-water contacts. The formation tags 100 may then be used to identify such contacts and may be used to monitor shifts or movement of such contacts over time.

In some variants, the information that may be contained in the signal 102 (FIG. 2) is embedded directly onto a wellbore by a method such as etching or scoring. In such variants, the injection module is configured to cut or engrave information bearing markings onto the wall of a wellbore. These markings may then be detected by a reader that contacts the wall of the wellbore.

From the above, it should be appreciated that what has been described includes, in part, a method for positioning a wellbore tool in a wellbore intersecting a subterranean formation. In one embodiment, the method may include positioning a tag at a selected location in the formation, and positioning the wellbore tool in the wellbore with reference to the tag. The selected location may at an open hole section of the wellbore, a position radially exterior of a wellbore tubular, or in a material forming the formation. In variants, the method may also include determining a parameter of interest relating to the formation, and determining the selected location using the determined parameter of interest. The parameter of interest may be measured using a logging tool positioned on a drill string and the method may include forming the wellbore using the drill string. The tag may be positioned at the selected location while the drill string is drilling the wellbore, while the drill string is being tripped into the wellbore, or while the drill string is being tripped out of the wellbore. In other variants, the parameter of interest may be measured using a logging tool conveyed by a non-rigid conveyance member; and the method may include logging the wellbore using the logging tool. The method may include logging a section of the wellbore to measure a parameter of interest relating to the formation, analyzing the measurements to determine the selected location, and relogging the section of the wellbore to locate the selected location.

Illustrative variants of the method may include embedding the tag in the formation and detecting the tag with a tag detection device associated with the wellbore tool. Still another method may include detecting a tag embedded in the formation; and positioning the wellbore tool in the wellbore with reference to the tag. Other variants of methods may include positioning a wellbore tool in a wellbore intersecting a subterranean formation that includes determining a parameter of interest relating to the formation; determining a selected location along the wellbore using the determined parameter of interest; positioning a tag at the selected location in the formation; detecting the tag; and positioning the wellbore tool in the wellbore with reference to the tag. The method may further include logging a section of the formation to measure the parameter of interest relating to the formation, and relogging the section of the wellbore to locate the selected location.

Illustrative methods may also include logging a section of the formation while traversing the wellbore in a first direction to obtain a first set of data relating to the formation; determining a selected location along the wellbore by processing the first set of data; logging the section of the formation while traversing the wellbore in a second direction opposite to the first direction to obtain a second set of data relating to the formation; processing the second set of data to find the selected location; and positioning a tag at the selected location in the formation.

From the above, it should be appreciated that what has been described includes, in part, a system for positioning a wellbore tool in a wellbore intersecting a subterranean formation. The system may include a tag positioned in the formation; a tag detection device operatively linking to the tag; and a conveyance device conveying the tag detection device into the wellbore. The tag detection device may use radio waves, acoustic waves, magnetic waves, and/or electromagnetic waves to operatively link with the tag. The tag may include an RFID transponder, a radioactive material, and/or a transmitter. The conveyance device include jointed tubulars, coiled tubing, a slickline, and/or a wireline.

An illustrative system may include a logging tool configured to determine at least one parameter of interest relating to the formation; a tag configured to be positioned in the formation; a tag insertion tool configured to insert the tag into the formation; and a conveyance device conveying the tag insertion tool and the logging tool into the wellbore.

In variants, the system may include a tag configured to be embedded in the subterranean formation to operate as the reference object; and an injector configured to embed the tag into the subterranean formation. The system may further include a sensor positioned adjacent the injector and configured to measure a selected parameter of interest relative to the subterranean formation. In one arrangement, the system may use a drill string to convey the injector into the wellbore. In arrangements, the system may include a non-rigid conveyance member conveying the injector into the wellbore.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

The invention claimed is:

1. A method for positioning a wellbore tool in a wellbore intersecting a formation, comprising:

determining a parameter of interest relating to the formation during a logging operation;

determining a selected location along the wellbore using the determined parameter of interest;

positioning a tag at the selected location in the formation during the logging operation;

detecting the tag; and positioning the wellbore tool in the wellbore with reference to the detected tag.

2. The method of claim 1 wherein determining the parameter of interest comprises using a logging tool in the wellbore to determine the parameter of interest relating to the formation.

3. The method of claim 2 further comprising forming the wellbore using a drill string, wherein the logging tool is positioned on the drill string.

4. The method of claim 3 wherein positioning the tag comprises positioning the tag at the selected location while the drill string is being tripped out of the well bore.

5. The method of claim 2 wherein determining the parameter of interest comprises conveying the logging tool by a non-rigid conveyance member; and further comprising logging the formation using the logging tool.

6. The method of claim 1 further comprising: logging a section of the formation to measure the parameter of interest relating to the formation, and relogging the section of the wellbore to locate the selected location.

7. The method of claim 1 wherein positioning of the tag includes embedding the tag in the formation.

8. The method of claim 1 further comprising detecting the tag with a tag detection device associated with the wellbore tool.

9. The method of claim 8 wherein the tag detection device uses one of: (i) radio waves, (ii) acoustic waves, (iii) magnetic waves, and (iv) electromagnetic waves to detect the tag.

10. The method of claim 8 wherein the tag transmits a signal to the tag detection device.

11. The method of claim 10 wherein the signal includes one of: (i) a unique identifier, (ii) reservoir data, (iii) formation data, (iv) fluid data, (v) borehole data, (vi) directional data, (vii) wellbore equipment data, (viii) completion data, and (ix) position data.

12. The method of claim 1 wherein the selected location is one of: (i) an open hole section of the wellbore, (ii) a position radially exterior of a wellbore tubular, and (iii) in a material forming the formation.

13. A system for positioning a wellbore tool in a wellbore intersecting a subterranean formation, comprising:

a logging tool configured to determine at least one parameter of interest relating to the formation during a logging operation;

a tag configured to be positioned in the formation;

a tag insertion tool configured to insert the tag into the formation during the logging operation; and a conveyance device conveying the tag insertion tool and the logging tool into the wellbore.

14. The system of claim 13 further comprising a tag detection device configured to detect the tag.

15. The system of claim 13 wherein the tag includes one of: (i) an RFID transponder, (ii) a radioactive material, and (iii) a transmitter.

16. The system of claim 13 wherein the conveyance device is one of: (i) jointed tubulars, (ii) coiled tubing, (iii) a slickline, and (iv) a wireline.

17. A method for positioning one or more devices in a wellbore intersecting a formation, comprising:

monitoring a section of the formation while traversing the wellbore in a first direction to obtain a first set of data relating to the formation;

determining a selected location along the wellbore by processing the first set of data;

logging the section of the formation while traversing the wellbore in a second direction opposite to the first direction to obtain a second set of data relating to the formation;

processing the second set of data to find the selected location; and positioning a tag at the selected location in the formation while traversing the wellbore in the second direction.

18. The method of claim 17, further comprising:

detecting the tag; and positioning a wellbore tool in the wellbore with reference to the tag.

19. The method of claim 17 wherein the positioning of the tag includes embedding the tag in the formation.

20. The method of claim 17 wherein processing the second set of data to find the selected location uses one of: (1) radio waves; (ii) acoustic waves, (iii) magnetic waves, and (iv) electromagnetic waves to detect the selected location.

* * * * *